US005108009A

United States Patent [19]

Davidson et al.

[11] Patent Number: 5,108,009

[45] Date of Patent: Apr. 28, 1992

[54] LEAK AND DRIP RESISTANT STORAGE DISPENSING AND MEASURING PACKAGE

[75] Inventors: Robert Davidson, Tokyo; Masami Namiki, Chiba; Harutoshi Iwai, Tokyo; Masaru Tamura, Chiba, all of Japan

[73] Assignee: Lever Brothers Company, Division of Conopco, Inc., New York, N.Y.

[21] Appl. No.: 737,578

[22] Filed: Jul. 29, 1991

Related U.S. Application Data

[63] Continuation of Ser. No. 356,588, May 23, 1989, abandoned, which is a continuation of Ser. No. 13,836, Feb. 12, 1987, abandoned, which is a continuation-in-part of Ser. No. 821,104, Jan. 21, 1986, abandoned.

[30] Foreign Application Priority Data

| | | | |
|---|---|---|---|
| Feb. 12, 1986 | [JP] | Japan | 61-18647[U] |
| Mar. 10, 1986 | [JP] | Japan | 61-34078[U] |
| Jul. 5, 1986 | [JP] | Japan | 61-103601[U] |
| Jul. 9, 1986 | [JP] | Japan | 61-105173[U] |

[51] Int. Cl.[5] ..... B67D 1/16

[52] U.S. Cl. ..... 222/109; 222/571

[58] Field of Search ..... 222/109, 111, 549, 562, 222/568, 570, 571; 215/1 C

[56] References Cited

U.S. PATENT DOCUMENTS

| | | | |
|---|---|---|---|
| D. 231,647 | 5/1974 | Morino . | |
| 2,061,685 | 11/1936 | Wheaton | 222/546 X |
| 2,601,039 | 6/1952 | Livingstone | 222/109 |
| 2,601,040 | 6/1952 | Livingstone | 222/109 |
| 2,690,281 | 9/1954 | Livingstone . | |
| 2,743,844 | 5/1956 | Livingstone | 222/111 |
| 2,763,402 | 9/1956 | Livingstone | 222/109 |
| 2,763,403 | 9/1956 | Livingstone | 222/570 X |
| 2,848,142 | 8/1958 | Livingstone | 222/111 |
| 2,851,196 | 9/1958 | Livingstone . | |
| 2,889,079 | 6/1959 | Livingstone . | |
| 2,915,223 | 12/1959 | Beall . | |
| 3,217,935 | 11/1965 | Burt . | |
| 3,240,404 | 7/1966 | Porter et al. | 222/521 |
| 3,300,104 | 1/1967 | Burt | 222/482 |
| 3,369,710 | 2/1968 | Lucas | 222/109 |
| 3,434,637 | 3/1969 | Marcel | 222/570 |
| 3,549,053 | 12/1970 | Anderson . | |
| 3,628,697 | 12/1971 | Dowson . | |
| 3,833,150 | 9/1974 | Visser-Patings | 222/109 |
| 4,078,700 | 5/1978 | Hidding | 222/109 |
| 4,128,189 | 12/1978 | Baxter | 222/109 |
| 4,298,145 | 11/1981 | Iida | 222/478 |
| 4,344,573 | 8/1982 | De Felice | 239/320 |
| 4,396,134 | 8/1983 | Owens | 222/562 |
| 4,427,138 | 1/1984 | Heinlein . | |
| 4,475,274 | 10/1984 | Beckstrom et al. | 222/562 X |
| 4,494,682 | 1/1985 | Beckstrom et al. | 222/551 |
| 4,550,862 | 11/1985 | Barker et al. | 222/109 |
| 4,566,508 | 1/1986 | Bowyer | 141/381 |
| 4,706,829 | 11/1987 | Li | 215/354 |

FOREIGN PATENT DOCUMENTS

| | | |
|---|---|---|
| 0132875 | 2/1985 | European Pat. Off. . |
| 8526425 | 9/1985 | Fed. Rep. of Germany . |
| 22525 | 8/1979 | Japan . |

*Primary Examiner*—Michael S. Huppert
*Assistant Examiner*—Gregory L. Huson
*Attorney, Agent, or Firm*—Gerard J. McGowan, Jr.

[57] ABSTRACT

A package for storing and dispensing pourable contents includes a container with a bottle having a neck with an opening in which there is mounted a gasket in the form of a pouring and drainback fitment. The fitment has a spout, a circumscribing well in communication with the bottle opening, and a lip supported on the neck of the bottle. A cap includes a measuring cup, the brim of which is received within the well of the fitment, when the container and cap are fastened. The threaded exterior wall of the cap is connected to the measuring cup by a web which is urged against the lip of the gasket forming drainback fitment to form a leak-proof seal when the cap is threaded onto the neck of the bottle.

11 Claims, 6 Drawing Sheets

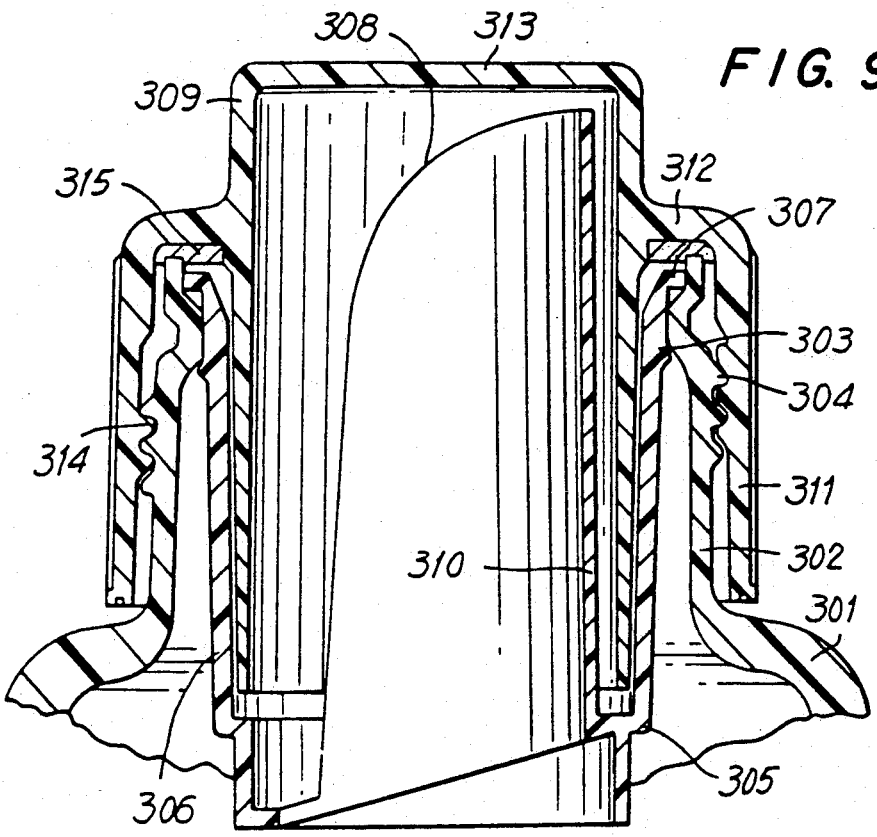
FIG. 9
FIG. 10
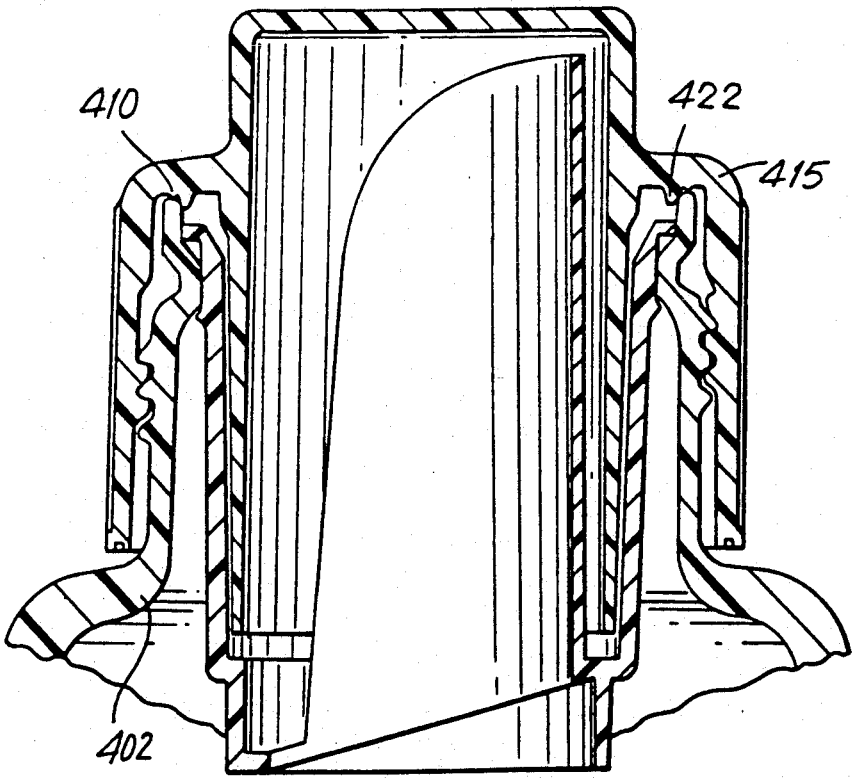

LEAK AND DRIP RESISTANT STORAGE DISPENSING AND MEASURING PACKAGE

This is a continuation of Ser. No. 07/356,588, filed May 23, 1989, now abandoned, which is a continuation of Ser. No. 07/013,836, filed Feb. 12, 1987, now abandoned, which is a continuation-in-part of Ser. No. 06/821,104, filed Jan. 21, 1986, now abandoned.

BACKGROUND OF THE INVENTION

Packages used for storing, dispensing and measuring pourable contents such as liquid detergents or fine grained powders are frequently plagued with the problems of leakage and dripping during shipping and storage and in connection with use of the package to dispense the contents. Various constructions for such packages have been adopted to alleviate the problem of leakage and dripping with only limited success.

For example, U.S. Pat. No. 4,550,862 to Barker et al. discloses a Liquid Product Pouring and Measuring Package with a Self Draining Feature having a drainback well and a closure used as a measuring cap. Liquid stored in the package bottle or remaining in the measuring cap can flow around the single wall of the measuring cap between the threads that join the closure and transition collar of the bottle, and collect on the exterior of the package. The package disclosed and claimed by Barker has been found to require the inclusion of a separate gasket disposed between the transition collar and neck of the bottle. Similar constructions wherein liquid in a bottle, or its residue intended to flow from a cap through a drainback well, can instead flow around and to the exterior of the single wall of the cap are disclosed in several patents granted to J. G. Livingstone, including U.S. Pat. No. 2,851,196 for an Adapter, U.S. Pat. No. 2,848,142 for a Container, U.S. Pat. No. 2,763,403 for Fittings, U.S. Pat. No. 2,743,844 for Pouring Spout with Cap and Drip Return, U.S. Pat. No. 2,690,281 for Capped Package with Adapter, and U.S. Pat. No. 2,601,040 for Fitting and Sealing Means Therefor.

U.S. Pat. No. 4,128,189 to Baxter for a Device for Improving the Pourability of Fluids and Also Forming an Improved Closure for a Container of Such Fluids discloses the use of a separate cap and measuring cup which is more complex and costly and less convenient than a single measuring closure.

The use of a dual walled cap to improve the seal on a bottle is disclosed in U.S. Pat. No. 2,061,685 to Wheaton for a Closure. However, Wheaton makes no provision for the use of his cap to prevent leakage in a container having a spout with a drainback feature.

There is provided a device including a measuring cap in Japanese Utility Model Publication No. 54-22525. The device is adapted to drop a measuring cylinder fitted loosely in a bottle mouth onto a cap top sheathing. Thus, a relatively large capacity can be given to the measuring cylinder and residual liquid in the cap will never drip to an outer surface of the bottle when it is again fitted on the mouth cylinder.

SUMMARY OF THE INVENTION

The present invention overcomes the aforementioned problems of the prior art in providing a package for storing and dispensing pourable contents including a container with a bottle having an opening and a gasket formed as a pouring and drainback fitment mounted within, and having a spout and a circumscribing well in communication with the bottle opening, and a cap having a closed end, an inner circumferential wall axially extending from the closed end to form a measuring cup, and an outer concentric wall connected to the inner wall by a web thereby forming a channel between the inner and outer walls, the container and closure having releasably engageable complementary fastener means, the spout being received within the measuring cup and the brim of the measuring cup being received within the well when the container and cap are fastened.

It is therefore an object of the invention to provide a package for storing, dispensing and measuring pourable contents which resists leakage and dripping.

Another object of the invention is to provide a package for storing, dispensing and measuring pourable contents having a spout to facilitate pouring and an internal drainback feature to enhance the return of residual contents to the storage portion of the package.

Still another object of the invention is to provide a package for storing, dispensing and measuring pourable contents in which a combined closure and measuring cap cooperates with a spout and drainback construction to impede flow of residual contents to the exterior of the package.

A further object of the invention is to provide a package for storing, dispensing and measuring pourable contents which is easy to use and economical to fabricate.

Still a further object of the invention is to provide a package for storing, dispensing and measuring pourable contents wherein there is no need for a gasket or liner to prevent leakage separate and apart from the pouring and drainback fitment.

An additional object of the invention is to provide a package for storing, dispensing and measuring pourable contents wherein the gasket comprising the pouring and drainback fitment seals itself to the neck of the bottle irrespective of whether the bottle is capped or uncapped.

Still an additional object of the invention is to provide a package for storing, dispensing and measuring pourable contents wherein the cap which seals the package is fastenable to the neck of the bottle and can still be used as a measuring cap.

Other and further objects of the invention will be apparent from the following drawings and description of a preferred embodiment of the invention in which like reference numerals are used to indicate like parts in the various views.

BRIEF DESCRIPTION OF THE DRAWINGS

FIG. 9 is a longitudinal sectional view showing a further preferred embodiment of the present invention.

FIG. 10 is a longitudinal sectional view showing a further preferred embodiment of the invention.

DETAILED DESCRIPTION OF THE INVENTION

Figure 1:
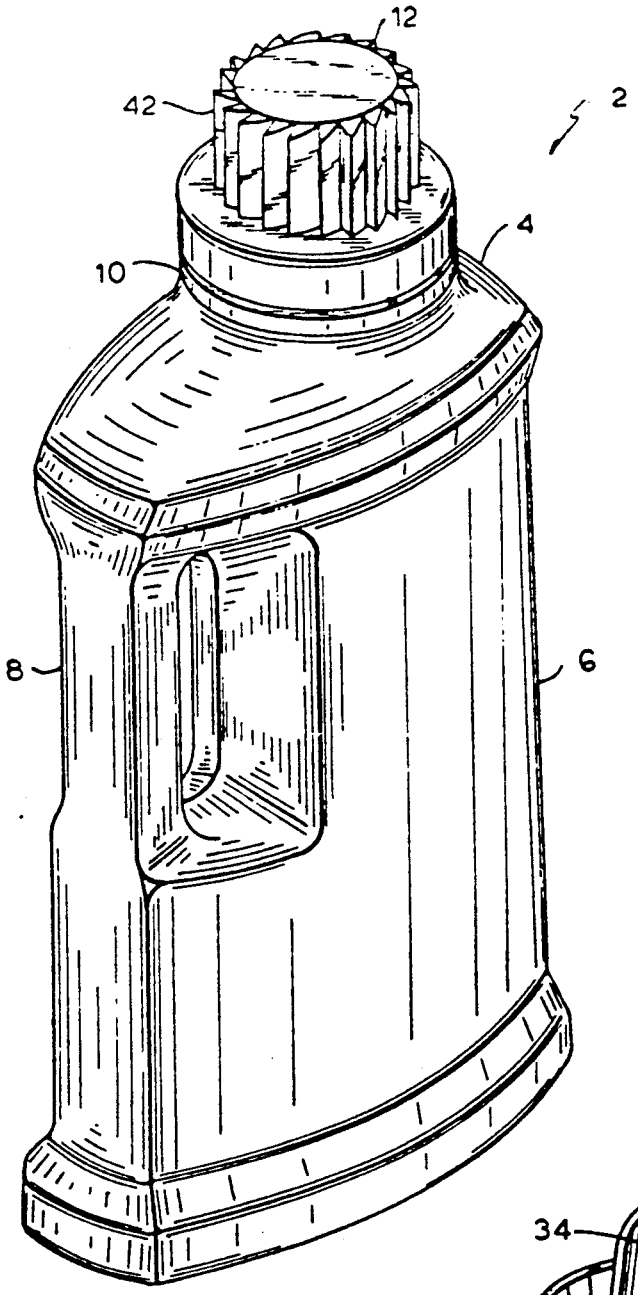
FIG. 1 is a perspective view of the preferred embodiment of the invention with closure fastened.
Figure 2:
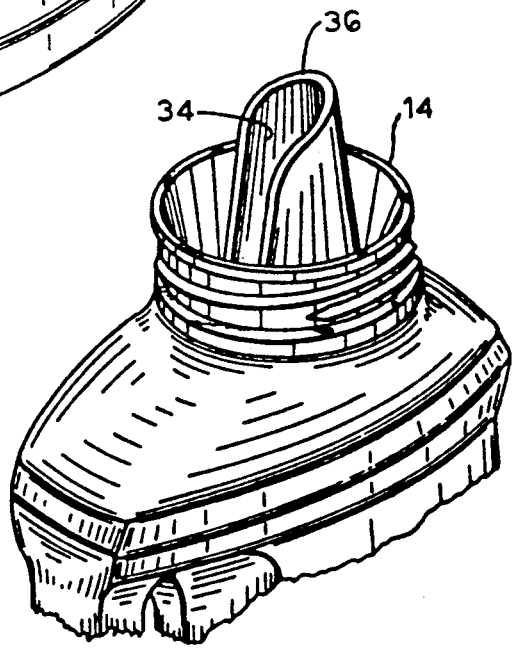
FIG. 2 is a perspective fragmentary view of the preferred embodiment of the invention with closure removed.

Referring now to FIGS. 1 and 2 of the drawings, there is shown a package 2 having a container 4 which includes a bottle 6 having an integral handle 8 and a neck 10. The container 4 also includes a drainback fitment 14. Fastened to the top of the container 4, as viewed in FIG. 1, there is a closure in the form of a cap 12. All of the foregoing components are preferably molded from a resilient flexible plastic material. The materials are selected so that the plastic from which the drainback fitment 14 is molded is softer than the materials from which the bottle 6 and cap 12 are formed. This enables the fitment 14 to function as a gasket for sealing the package 2 when the cap 12 is fastened to the bottle 6 in addition to serving the purposes of pouring contents from and draining their residue back into the bottle 6.

Figure 3:
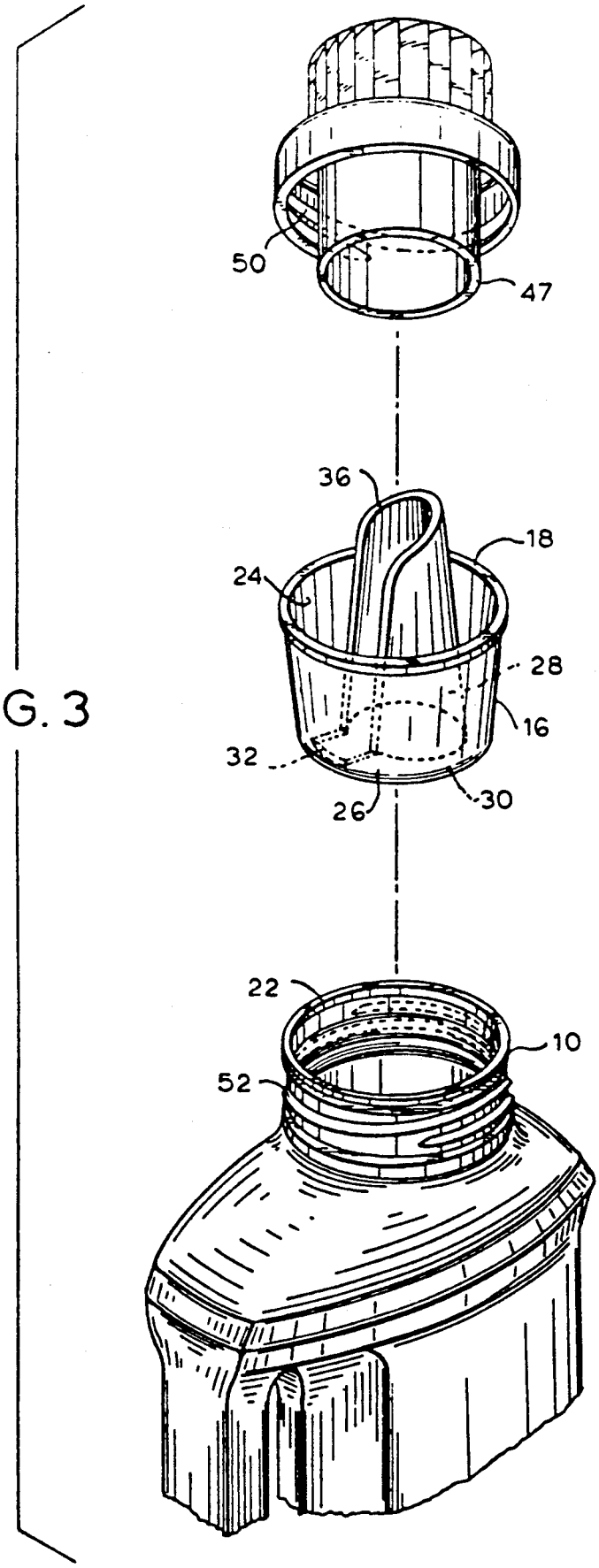
FIG. 3 is an exploded perspective view of the preferred embodiment of the invention.
Figure 4:
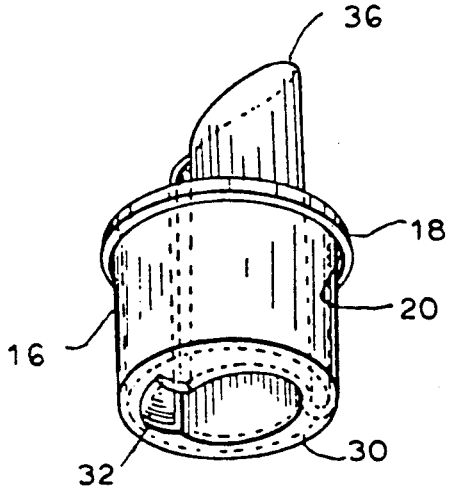
FIG. 4 is a perspective phantom view of the spout and drainback fitment of the preferred embodiment of the invention.

As can best be seen in FIGS. 3 and 4, the drainback fitment 14 has an outer, frustoconical wall portion 16 which gradually tapers downwardly and inwardly and is received within the neck 10 of the bottle 6. The wall portion 16 terminates at its upper end in a radial flange with a rolled lip 18. A downwardly tapering circumferential channel 20 is formed between the cylindrical wall portion 16 and the lip 18. The brim of the neck 10 has a bead 22 which is force fitted into the channel 20 thereby retaining the drainback fitment 14 on the neck 10 of the bottle 6.

The surface of the lip 18 opposite the one forming the channel 20 rolls upwardly from the extreme radius of the drainback fitment 14 and then downwardly and inwardly to form the outer wall 24 of the circumferential well 26 surrounding a generally frustoconical, eccentrically positioned spout 36, the lower periphery of which forms the inner wall 28 of the circumferential well 26. Between the outer wall 24 and inner wall 28 of the circumferential well 26 there is a sloping floor 30.

A substantially rectangular notch 32 cut from the lowermost and widest portion of the floor 30 is in alignment with a longitudinal slot 34 in the frustoconical wall of the spout 36 so that the openings formed by the longitudinal slot 34 and notch 32 are merged at their intersection. The longitudinal slot 34 and notch 32 are in communication with the opening in the neck 10 of the bottle 6. The longitudinal slot 34 and notch 32 provide a path for residual liquid remaining on the spout 36 or cap 12 to drain back into the bottle 6 either directly or via the downward sloping floor 30 of the circumferential well 26 under the force of gravity when the package 2 is in an upright position.

The drainback fitment 14 is preferably formed from a medium density plastic such as medium density polyethylene. In the preferred embodiment of the invention, the medium density polyethylene is the product of a 50:50 blend of a high density resin and a low density resin. The high density resin can be U.S.I. LS 506 or a similar resin. The low density resin can be USI LS 208 or similar. Other plastic resins having chemical and physical properties similar to the aforementioned resins marketed by U.S.I. Chemicals can be used to form a medium density plastic suitable for use in fabricating the drainback fitment 14.

Figure 5:
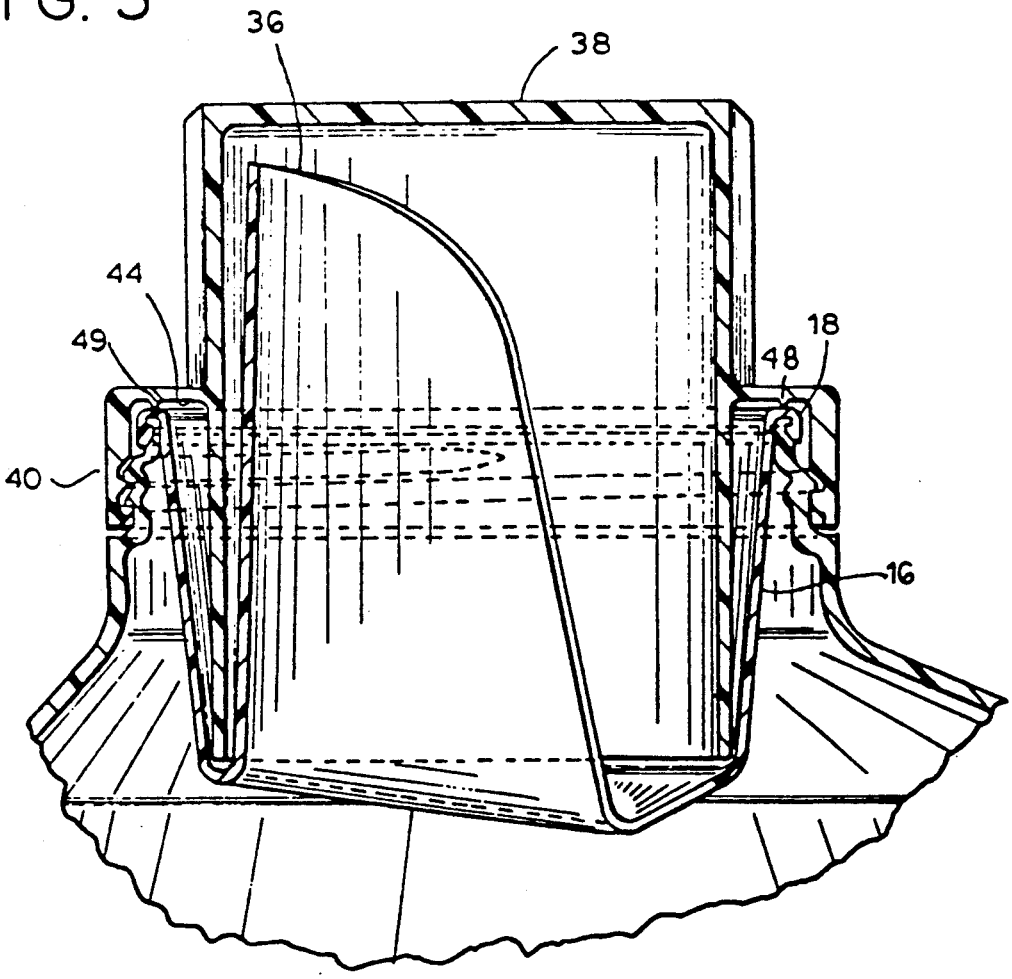
FIG. 5 is a fragmentary sectional elevation view of the preferred embodiment of the invention.
Figure 6:
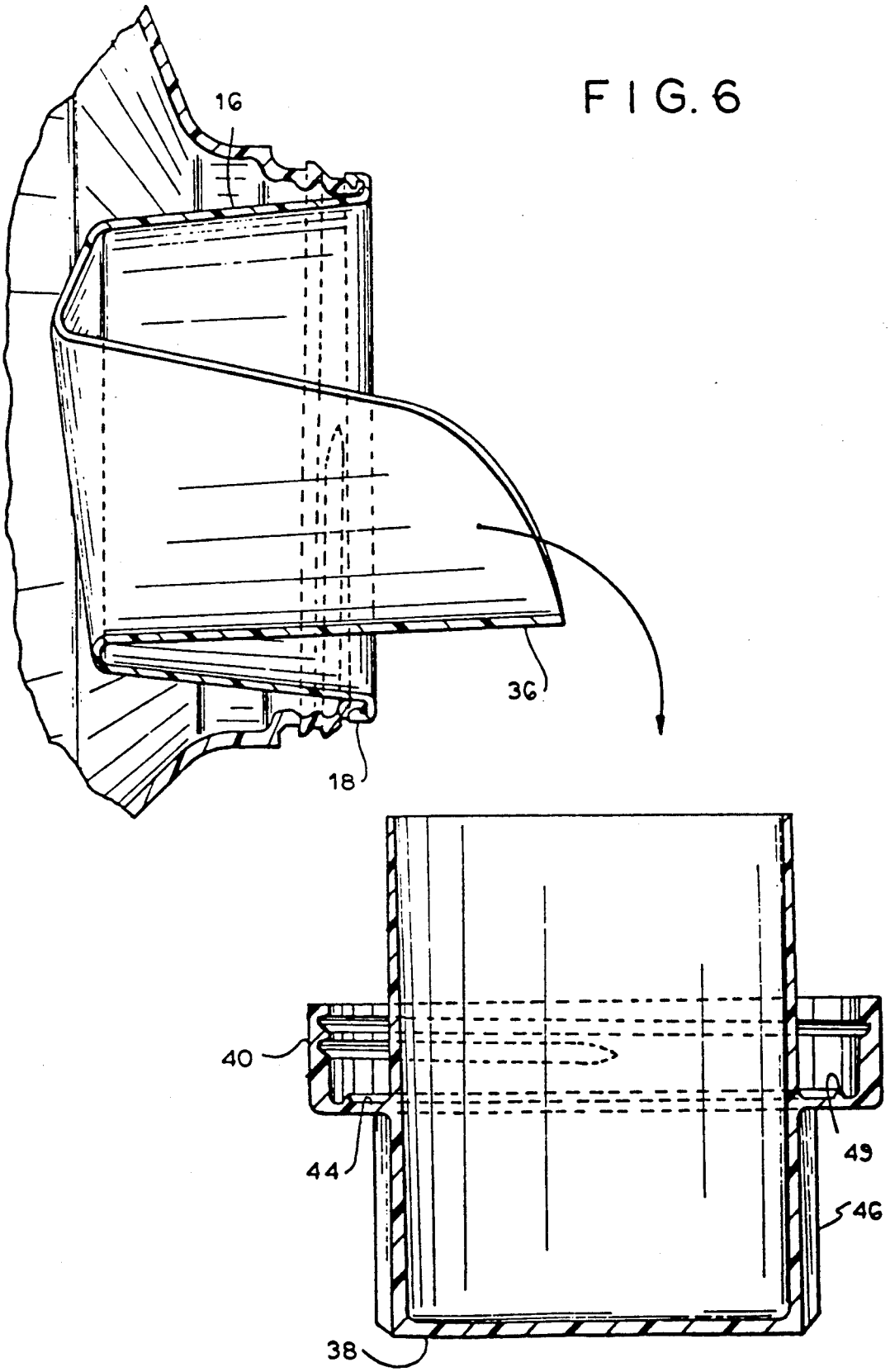
FIG. 6 is a sectional view of the preferred embodiment of the invention in one of its uses.

Referring now to FIGS. 5 and 6, the cap 12 is shown in detail. The cap 12 has a closed end 38 at its top which is merged at its circumference with a downwardly extending outer circumferential wall 40 having a surface into which there are integrally molded gripping teeth 42 biased to present greater friction to the hand when the cap 12 is rotated counterclockwise to loosen it than when it is rotated clockwise for tightening.

An inner circumferential wall 46 concentric with and spaced from the outer circumferential wall 40 extends downwardly beyond the length of the outer circumferential wall 40. The inner circumferential wall 46 and the undersurface of the closed end 38 form a cup for measuring the contents of the package 2 as it is poured from the container 4 as illustrated in FIG. 6. A fill line can be molded into the inner circumference of the inner wall 46.

The outer circumferential wall 40 and inner circumferential wall 46 are connected by a web 48 so that a downwardly facing (when the cap 12 is fastened to the container 4) channel 44 is defined between the inner circumferential wall 46 and outer circumferential wall 40. The channel 44 in cooperation with the frustoconical wall portion 16 and lip 18 of the drainback fitment 14 serves as a trap for preventing residual contents of the package 2 from migrating to the junction of the cap 12 and neck 10 of the bottle 6. The web 48 has an integral circular rib 49 tapering to a narrow edge projecting through the channel 44 and presenting a knife-edge bearing surface to the lip 18.

The cap 12 is formed of a harder material than that used in the drainback fitment 14. In the preferred embodiment of the invention, the plastic material from which the cap 12 is molded is a homopolymer polypropylene such as that sold by Phillips Petroleum Company under the designation Phillips HLV 120-01.

The bottle 6 is also formed of a material that is harder than the material employed in the drainback fitment 14. In the preferred embodiment of the invention, the bottle is fabricated from a high density polyethylene. Another resin sold by U.S.I. under the designation 0.955 density, OI-388-2 has been found to be one such suitable material. Other materials exhibiting similar chemical and physical properties can be substituted.

Complementary fastener means in the form of threads are provided on the cap 12 and neck 10 of the bottle 6 at their juncture. The cap 12 has internal threads 50 which mate with external threads 52 on the neck 10 of the bottle. As the cap 12 is threaded onto the neck 10 of the bottle 6, the web 48 in the channel engages the lip 18 of the drainback fitment 14 thereby resiliently compressing the lip 18 and urging the edge of the circular rib 49 on the web 48, lip 18, and neck 10 into hermetically sealing engagement to prevent leakage of the contents from the package 2. Contemporaneously, the brim 47 of the inner circumferential wall 46 of the closure 12 is brought into close proximity with the floor 30 of the well 26 and ideally engages one or more of the walls 24 and 28 and the floor 30 of the well 26 where permitted by the tolerances inherent in the molding process.

Hence the walls 24 and 28 of the drainback fitment 14 and the walls 40 and 46 present barriers to leakage of the contents of the package 2. The flow of the contents of the package around the walls 24, 28, 40, and 46 is prevented by the circular rib 49 engaging the lip 18, the brim 47 of the inner circumferential wall 46 being in close proximity with the floor 30 of the well 26 and the threads 50 and 52 engaging one another.

Improvements may be made to the illustrated embodiments. For instance, the notch 32 may be decreased in size to reduce the risk that liquid will inadvertently flow through the notch during pouring from the bottle. Also, a drain port may be placed in wall 16, such as above notch 32, to permit the last drops of liquid to be poured from the bottle. The inner surface of the outer circumferential wall 40 may be thickened in the area adjacent the downwardly extending surface of lip 18 whereby to seal against lip 18 of the drainback fitment when the cap is screwed onto the bottle. Modifications may be made to prevent the spout from rotating within the bottle mouth. For example, a projection can be added to the mouth which is received within a corresponding recess in the spout, thereby preventing relative rotation.

Figure 7:
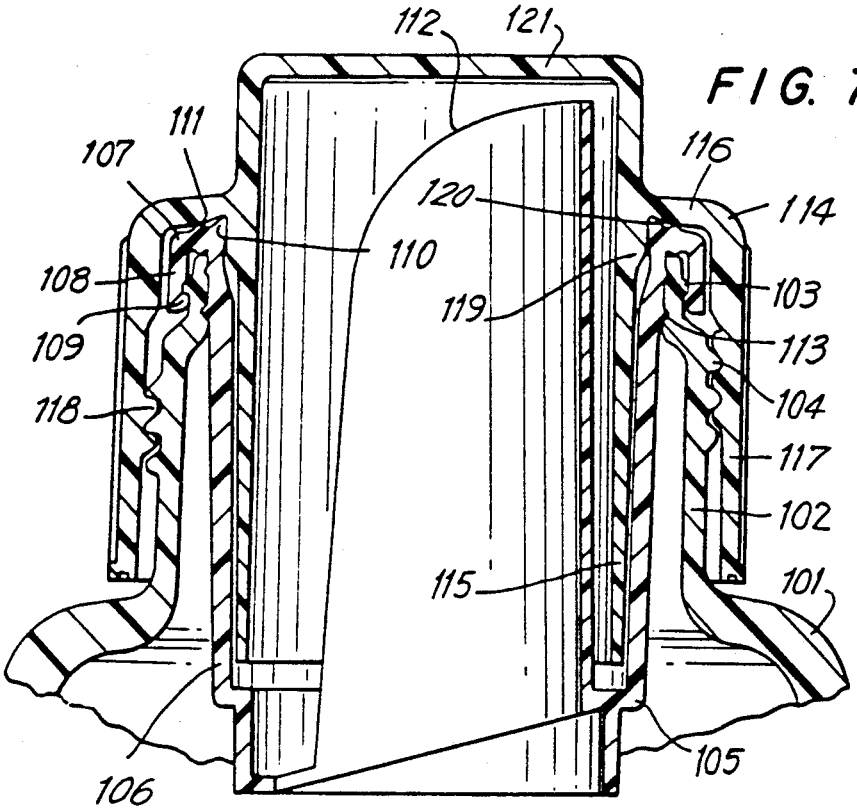
FIG. 7 is a longitudinal sectional view showing an alternate embodiment of the invention.

The device of FIG. 7 relates to a cap apparatus to be fitted on a mouth cylinder of a bottle, which is superior in hermetic seal, better suited for pouring of liquids and capable of measuring the quantity of a poured liquid.

Referring now to FIG. 7, the cap apparatus according to the present device is comprised of a bottle 101, a plug body 105 and a measuring cap 114.

A locking circumferential ridge 103 is provided on an outer peripheral surface of the upper end portion of a mouth cylinder 102 of the bottle 101 containing a liquid, and a spiral ridge 104 is provided on a lower outer peripheral surface of the locking circumferential ridge 103.

The plug body 105 is made of soft synthetic resin, wherein an outer cylinder 108 is dropped from an upper end of a cylindrical wall 106 fitted closely in the mouth cylinder 102 through an outer collar 107, and a locking ridge 109 locking under the locking circumferential ridge 103 of the mouth cylinder 102 is provided on an inner peripheral surface of the outer cylinder 108.

A tapered flume-like guide piece 112 is provided on a lower end of the cylindrical wall 106 vertically within the cylindrical wall 106, and a leading portion of the guide piece 112 protrudes from a upper end of the cylindrical wall 106.

The measuring cap 114 is cylindrical, with its circumferential wall 115 ready for inserting and positioning between the cylindrical wall 106 and the guide piece 112. A built-in cylinder 117 is dropped on an outer periphery of the circumferential wall 115 through a collar 116, and a spiral ridge 118 engagable with spiral ridge 104 is provided on an inner peripheral surface of the cylinder 117.

A sealing ridge 110 protruding slantingly upward is provided on an inner peripheral end of the upper surface of the outer collar 107 of the plug body 105, and a seal part 119 with which the sealing ridge 110 comes in contact closely and elastically is swelled thick to the sealing ridge 110 at an outer peripheral surface of the circumferential wall 115 at a portion directly under the collar 116 of the measuring cap 114.

A lower surface of the outer collar 107 of the plug body 105 comes in close contact with an upper end surface of the mouth cylinder 102 when the plug body 105 is installed in the mouth cylinder 102, thereby attaining sealing of a portion between the bottle 101 and the plug body 105. An upper surface of the outer collar 107 of the plug body 105 comes in close contact with a lower surface of the collar 116 of the measuring cap 114 installed in the mouth cylinder 102, thereby attaining sealing of a portion between the measuring cap 114 and the plug body 105; however, the arrangement is such that the seal between the plug body 105 and the measuring cap 114 will be attained firmly and securely by a close and elastic contact of the sealing ridge 110 with the seal part 119.

In the configuration described above, the plug body 105 is made of a soft synthetic resin, the cylindrical wall 106 is fitted closely within the mouth cylinder 102, and the locking ridge 109 of the outer cylinder 108 locks from underneath the locking circumferential ridge 103 of the mouth cylinder 102 to fit securely thereto. Therefore the plug body 105 can be fitted to the mouth cylinder 102 and so maintained firmly.

The circumferential sealing ridge 110 of the plug body 105 is deformed elastically to come in close contact with the seal part 119 of the measuring cap 114 when the plug body 105 is installed in the mouth cylinder 102 and further the measuring cap 114 is fitted in the mouth cylinder 102. Therefore the hermetic seal between the plug body 105 and the measuring cap 114 can be attained firmly and securely.

Accordingly, if the measuring cap 114 is formed, for example, of a hard synthetic resin so as to be kept from deformation when engaged to fit within the mouth cylinder 102, a hermetic seal of the bottle 101 can be attained thoroughly nevertheless.

Further, since the guide piece 112 provided on the plug body 105 is tapered and flume-like to protrude from within the cylindrical wall 106, a liquid in the bottle 101 is poured out by the guide piece 112, and thus an operation for pouring the liquid into the measuring cap 114 from within the bottle 101 can be facilitated.

Accordingly, the measurement of a poured-out liquid by means of the measuring cap 114 can be attained easily, and when the measuring cap 114 is fitted within the mouth cylinder 102, a portion of the circumferential wall 115 whereat the liquid is measured is positioned within the cylindrical wall 106 of the plug body 105. Therefore, the liquid remaining in the measuring cap 114 returns securely into the bottle 101, and thus the outer surface of the bottle 101 will never be stained.

Further, the sealing ridge 110 is formed and structured to protrude slantingly upward independently. Therefore, even if the opening at the upper end portion of the sealing ridge 110 is smaller than an inside diameter of the upper end portion of the cylindrical wall 106, it can be curved and so thoroughly deformed elastically outwardly when released from a molding die that smooth release is attained.

In the embodiment given in FIG. 7 a sealing piece 111 for securing a hermetic seal with the measuring cap 114 more firmly is provided projectingly on an upper surface of the outer collar 107 of the plug body 105. A sealing ridge 11' is provided on a lower surface of the outer collar 107 so as to attain a hermetic seal with the bottle 101 more firmly at the same time, and thus a seal of the bottle 101 according to the measuring cap 114 by means of the plug body 105 can be attained more securely and firmly by the sealing piece 111 and the sealing ridge 111'.

A sealing ridge 113 is provided on an upper end portion of the outer peripheral surface of the cylindrical wall 106 of the plug body 105, and thus a seal between the plug body 105 and the mouth cylinder 102 will be strengthened as a result of the sealing ridge 113 coming in contact elastically with an inner peripheral surface of the mouth cylinder 102 when the cylindrical wall 106 is fitted within the mouth cylinder 102.

Further, there is provided an annular groove-like recess part 120 on an inner peripheral end portion of the collar 116 of the measuring cap 114, thereby ensuring an elastic deformation of the sealing ridge 110.

The guide piece 112 provided in the plug body 105 is tapered and flume-like from formation as by, for example, cutting a cylinder slantingly, and the leading portion protrudes upwardly from the cylindrical wall 106. The circumferential wall 115 of the measuring cap 114 is high enough to receive the guide piece 112 therein, and thus the collar 116 protruding from an outer peripheral surface of the circumferential wall 115 comes to protrude from the position somewhat lower than an upper end of the circumferential wall 115, which would be blocked by a top wall 121.

As described above, the device is effective in securely and firmly attaining a hermetic seal of the plug body and the measuring cap or a hermetic seal of the mouth cylinder and the plug body. A large-sized bottle with an aperture of the mouth cylinder small as compared with a diameter of the bottle body can be sealed and so retained securely and the quantity of a poured-out liquid can be measured easily, smoothly and accurately by means of the measuring cap. Further, the structure is simplified to facilitate forming, and an incorrect forming due to mold release will never be caused thereby.

Figure 8:
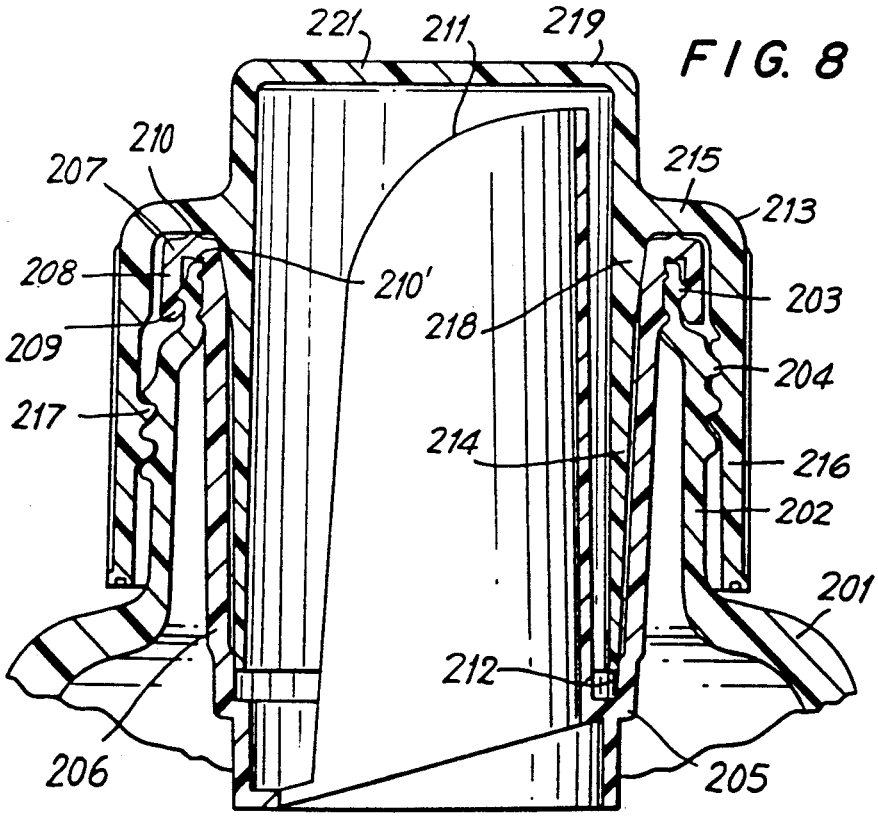
FIG. 8 is a longitudinal sectional view showing a further alternate embodiment of the invention.

The device of FIG. 8 relates to a cap apparatus to be fitted on a mouth cylinder of a bottle, which is superior in hermetic seal, easily used to pour out a liquid and capable of measuring the quantity of a poured liquid.

The invention of FIG. 8 involves arranging a sealing ridge between a plug body fitted closely in a bottle mouth cylinder and a measuring cap fitted on the mouth cylinder as an outer cap. The sealing is secured by engaging and tightening the measuring cap with the mouth cylinder. However, a molding die is somewhat complicated for providing the sealing ridge, and since sealing is attained by a tightening and pushing force through engagement of the measuring cap, there remains some uncertainty.

The device of FIG. 8 is intended to remove problems, defects and improperness prevailing in conventional arrangements, and its object is to provide a device which is superior in hermetic seal, lends itself to easy pouring of a liquid and is capable of measuring the quantity of a poured liquid.

The cap apparatus of FIG. 8 comprises a bottle 201, a plug body 205 and a measuring cap 213. The bottle 201 contains a liquid. A spiral ridge 204 is provided on an outer peripheral surface of a mouth cylinder 202.

The plug body 205 is made of a soft synthetic resin, wherein a tapered flume-like guide piece 211 is provided on a lower end of a cylindrical wall 206 fitted closely within the mouth cylinder 202 vertically within the cylindrical wall 206. A leading portion of the guide piece 211 protrudes from an upper end of the cylindrical wall 206.

The measuring cap 213 is cylindrical with its circumferential wall 214 ready for inserting and positioning between the cylindrical wall 206 and the guide piece 211. A built-in cylinder 216 is dropped from an outer periphery of the circumferential wall 214 through a collar 215, and a spiral ridge 217 engagable with the spiral ridge 204 is provided on an inner peripheral surface of the built-in cylinder 216.

An outside diameter of the circumferential wall 214 at a portion lower than the collar 215 of the measuring cap 213 is set to a value whereby it can be fitted closely in an upper end opening of the cylindrical wall 206 of the plug body 205. An inside diameter of a lower portion of the cylindrical wall 206 of the plug body 205 is set to a value whereby a lower portion of the circumferential wall 214 of the measuring cap 213 is fitted closely therein.

Since the outside diameter of a predetermined upper portion of the circumferential wall 214 of the measuring cap 213 is set to a value whereby it can be fitted closely in an upper end opening of the cylindrical wall 206 of the plug body 205, the circumferential wall 214 is fitted closely in the cylindrical wall 206 and thus a hermetic seal at each upper portion between the cylindrical wall 206 and the circumferential wall 214 is attained upon engagement of the measuring cap 213 with the mouth cylinder 202 on condition that the plug body 205 is fitted closely in the mouth cylinder 202. Furthermore, since the inside diameter of a lower portion of the cylindrical wall 206 of the plug 205 is set to a value whereby a lower portion of the circumferential wall 214 of the measuring cap 213 is fitted closely therein, a lower end portion of the circumferential wall 214 is fitted closely in a lower end portion of the cylindrical wall 206 and thus a hermetic seal at each lower portion between the cylindrical wall 206 and the circumferential wall 214 is attained.

In the above-described configuration, since the plug body 205 is made of a soft synthetic resin, when the plug body 205 is fitted closely on the mouth cylinder 202 and further the measuring cap 213 is fitted on the mouth cylinder 202, the predetermined upper portion of the circumferential wall 214 of the measuring cap 213 is fit forcedly and closely in the upper end opening of the cylindrical wall 206 of the plug body 205 and also the lower portion of the cylindrical wall 206 of the plug body 205 is fit forcedly and closely in the lower portion of the circumferential wall 214 of the measuring cap 213, each deforming the cylindrical wall 206 of the plug body 205 elastically. Therefore the hermetic seal at each portion is attained firmly and securely.

Thus, if the measuring cap 213 is formed, for example, of a hard synthetic resin so as not to deform particularly a portion of the circumferential wall 214 even upon screwing it to the mouth cylinder 202, a satisfactory hermetic seal is obtainable.

If the circumferential wall 214 of the measuring cap 213 is fit forcedly and closely within the cylindrical wall 206 of the plug body 205, then particularly an outer peripheral surface of an upper portion of the cylindrical wall 206 of the plug body 205 is pressed strongly onto an inner peripheral surface of the mouth cylinder 202. Therefore, a close fitting of the mouth cylinder 202 of the plug body 205 will be further strengthened.

Since the guide piece 211 provided on the plug body 205 is tapered and flume-like to protrude from within the cylindrical wall 206, a liquid in the bottle 201 is poured out as regulated by the guide piece 211. Thus, an operation for pouring the liquid into the measuring cap 213 from within the bottle 201 will be facilitated.

The measurement of a poured-out liquid by means of the measuring cap 213 can be attained easily. Under the state where the measuring cap 213 is fitted within the mouth cylinder 202, a portion of the circumferential wall 214 whereat the liquid is measured is positioned within the cylindrical wall 206 of the plug body 205.

Therefore the liquid remaining in the measuring cap 213 returns securely into the bottle 201, and thus an outer surface of the bottle 201 will never be stained.

In the embodiment given in FIG. 8, a locking circumferential ridge 203 is provided on an outer peripheral surface of the mouth cylinder 202 of the bottle 201 at a portion higher than the spiral ridge 204.

A short cylindrical outer cylinder 208 is dropped from an upper end of the cylindrical wall 206 of the plug body 205 through an outer collar 207, and a locking ridge 209 locking from under the locking circumferential ridge 203 of the mouth cylinder 202 and undercut to fitting securely thereto is provided on an inner peripheral surface of the outer cylinder 208.

A sealing piece 210 for securing a hermetic seal with the measuring cap 213 more firmly is provided projectingly on an upper surface of the outer collar 207 of the plug body 205. A sealing ridge 210' is provided on a lower surface of the outer collar 207 so as to attain a hermetic seal with the bottle 201 more firmly at the same time. Thus, a seal of the bottle 201 with the measuring cap 213 by means of the plug body 205 can be attained more securely and firmly by the sealing piece 210 and the sealing ridge 210'.

A lower end portion of the cylindrical wall 206 of the plug body 205 is a fitting cylinder part 212 with a somewhat small inside diameter, and a lower end portion of the circumferential wall 214 of the measuring cap 213 is fitted closely within the fitting cylinder part 212.

The circumferential wall 214 at a portion lower than the collar 215 of the measuring cap 213 is a walled sealing part 218 which is tapered gradually downwardly, and an outside diameter of the sealing part 218 is set to a value whereby it can be fit closely within an upper end opening of the cylindrical wall 206 of the plug body 205.

The guide piece 211 provided in the plug body 205 is tapered and flume-like from forming as by, for example, cutting a cylinder slantingly. The leading portion of the guide piece protrudes upwardly from the cylindrical wall 206. Therefore, the circumferential wall 214 of the measuring cap 213 is high enough to contain the guide piece 211 therein, and thus the collar 215 protruding from an outer peripheral surface of the circumferential wall 214 comes to protrude from the position somewhat lower than an upper end of the circumferential wall 214, which would be blocked by a top wall 221.

As described above, the device of FIG. 8 is effective in securely and firmly attaining a hermetic seal of the plug body and the measuring cap or a hermetic seal of the mouth cylinder and the plug body. A large-sized bottle with an aperture of the mouth cylinder which is small as compared with the diameter of the bottle body can be sealed and so retained securely and the quantity of a poured-out liquid can be measured easily, smoothly and accurately by means of the measuring cap. Moreover, the structure is simplified to facilitate forming, and an incorrect forming due to mold release will never be caused thereby.

The device of FIG. 9 relates to a cap apparatus to be fitted on a mouth cylinder of a large-sized and wide-mouthed bottle, which is superior in hermetic seal, easy to use in pouring a liquid and capable of measuring the quantity of a poured liquid.

A large-sized wide-mouthed bottle of synthetic resin is inferior in molding precision of the inner peripheral surface of a mouth cylinder, uneven in smoothness of an upper end surface of the mouth cylinder, capable of causing a deformation due to resin contraction after molding, and further does not compensate for out-of-roundness due to bulging in most cases. Such problems result in a defect in the ability to attain a hermetic seal securely.

Meanwhile, wide-mouthed bottles include an outer cap working as the measuring cap for measuring the quantity of a liquid poured out; furthermore, there may be provided in such types of the wide-mouthed bottle as will fit a plug body having a tapered flume-like guide piece for facilitating a liquid pouring operation into the measuring cap in the mouth cylinder.

In order to attain a seal securely by means of the measuring cap and the plug body as described, both the members will be complicated in construction inevitably to some extent, which may involve another problem that a molding requires much time and thus entails a higher cost.

The device of FIG. 9 has been made to remove the above-mentioned problems and defects prevailing hitherto, and its object is to provide such a cap apparatus as is simple in construction but superior in hermetic seal, satisfactory in formability and further is obtainable at a moderate cost.

Referring now to FIG. 9, the cap apparatus of the present device comprises a plug body 305, a measuring cap 309 and a packing 315. The plug 305 is made of a soft synthetic resin, wherein a tapered flume-like guide piece 308 is provided vertically to protrude from a lower end of a cylindrical wall 306 fitted in a mouth cylinder of a wide-mouthed bottle 301, and a leading portion of the guide piece 308 protrudes from an upper end of the cylindrical wall 306.

The measuring cap 309 includes a top and is double cylindrical with its circumferential wall 310 ready for inserting and positioning between the cylindrical wall 306 and the guide piece 308 and a built-in cylinder 311 dropped from an outer periphery of the circumferential wall 310 through a collar 312. Furthermore, a spiral ridge 314 engagable with a spiral ridge 304 on a mouth cylinder 302 is provided on an inner peripheral surface of the built-in cylinder 311.

The packing 315 is shaped like a ring and fitted on the measuring cap 309 to come in contact with a lower surface of the collar 312 of the measuring cap 309, thus coming in contact close with an upper end surface of the mouth cylinder 302 when the measuring cap 309 is secured on the mouth cylinder through screwing engagement.

The measuring cap 309 is capable of containing a predetermined quantity of liquid within the circumferential wall 310 by demounting it from the mouth cylinder 302 and turning it upside down. Since the tapered flume-like guide piece 308 is provided vertically in the plug body 305 protruding from an upper end of the cylindrical wall 306, a liquid in the bottle 301 will be poured out bit-by-bit in a certain direction through the guide piece 308 by inclining the bottle 301 in a predetermined direction, and thus the liquid can be poured into the measuring cap 309 very easily.

The packing 315 is fit into an annular groove and comes in contact with a lower surface of the collar 312, which forms a bottom of the annular groove formed between the circumferential wall 310 and the built-in cylinder 311.

As described above, the packing 315 can be fitted securely to the measuring cap 309 through fitting in the annular groove. Therefore the fitting to the measuring cap 309 is relatively stable and the fitting operation may be simplified accordingly.

In the configuration described above, the packing 315 is positioned to come in contact with a lower surface of the collar 312 of the measuring cap 309 and then comes in contact with an upper end surface of the mouth cylinder 302 by screwing the measuring cap 309 onto the mouth cylinder 302. Therefore a hermetic seal in the bottle 301 is attained securely.

That is, the portion whereat the packing 315 is positioned is a limited area restricted by an outer peripheral surface of the upper end portion of the circumferential wall 310 a lower surface of the collar 312 and an inner peripheral surface of the upper end portion of the built-in cylinder 311. Therefore, the sealing here will be attained directly by a force applied concentrically through the packing 315 positioned between the measuring cap 309 and the mouth cylinder 302 screwed with each other.

Since the packing 315 is retained securely between the circumferential wall 310 and the built-in cylinder 311, problems such as dislocation or the like will never result. Further, the above-mentioned sealing is attained by the packing 315; therefore the sealability of the plug body 305 to the mouth cylinder 302, or of the measuring cap 309 to the mouth cylinder 302 and further between the plug body 305 and the measuring cap 309 is not particularly required, and hence the construction of the plug body 305 or the measuring cap 309 will be simplified to a considerable extent.

The packing 315 is an independent product. Therefore a material with high packing effect can be selected and set arbitrarily from among the molding materials, thereby securing a high sealing effect.

The bottle 301 for containing a liquid has a locking circumferential ridge 303 provided on an inner peripheral surface of the upper end portion of the mouth cylinder 302, and the spiral ridge 304 provided also on the outer peripheral surface.

The plug body 305 is made of a soft synthetic resin, wherein a locking ridge 307 below which the locking circumferential ridge 307 locks is provided on an upper end outer periphery of the cylindrical wall 306 to be fitted in the mouth cylinder 302.

The guide piece 308 provided in the plug body 305 is tapered and flume-like from forming as by, for example, cutting a cylinder slantingly, and is provided vertically at a height allowing its leading portion to protrude from an upper end of the cylindrical wall 306. Therefore, the circumferential wall 310 of the measuring cap 309 is high enough to receive and position the guide piece 308. The collar 312 provided on an outer periphery of the circumferential wall 310 comes somewhat lower than an upper end of the circumferential wall 310 accordingly, and a topped cylindrical form of the measuring cap 309 is secured by providing a top wall 313 on the upper end of the circumferential wall 310.

As described below, a liquid can be poured out at a predetermined quantity all the time by means of the measuring cap 309, and in addition the direction in which a liquid is poured out of the bottle 301 is accurate. A portion of the circumferential wall 310 having contained the liquid therein is positioned within the cylindrical wall 306 of the plug body 305 under the state where the measuring cap 309 is refitted on the mouth cylinder 302. Therefore, the liquid remaining in the measuring cap 309 returns surely into the bottle 301, and consequently an outer surface of the bottle 301 will never be stained.

The ring-shaped packing 315 is a member rich in elastic deformation which is formed, for example, of a soft rubber and the like, deformable by the measuring cap 309 and the mouth cylinder 302 through pressing and holding vertically. The packing works to seal the mouth cylinder 302 securely.

As will be apparent from the description given above, in the cap apparatus according to the present device, since a hermetic seal having great sealing effectiveness is applied directly between the measuring cap and the mouth cylinder of the bottle, the seal is secured and a high sealing effect is obtainable. A satisfactory hermetic seal can be attained despite a deformation arising somewhat on the mouth cylinder. In addition, the quantity of a liquid poured out can be measured accurately, an operation for pouring out a liquid contained therein is facilitated, the plug body and the measuring cap can be structured without taking a sealing function into consideration, and therefore the structure can be simplified for easy molding, thus ensuring various superior effects.

The embodiment of FIG. 10 is similar to that of FIG. 9, except that the packing of FIG. 9 is not used. Instead, a sealing ridge 410 depends from collar 415 and abuts the top of mouth cylinder 402 when the cap is screwed onto the bottle. Also, inside diameter plug 422 depends from collar 415 and abuts the inner surface of mouth cylinder 402 when the cap is screwed onto the bottle.

It will be apparent that any of the embodiments may include a notch 32 or other drainage opening in the lower areas of the floor of the plug body as illustrated in FIGS. 4 and 5 so that liquid poured into the plug body can flow down to the drain and into the bottle.

It will be appreciated that the foregoing is a description o preferred embodiments to which variations and modifications can be made without departing from the spirit of the invention. Various features of the separately illustrated embodiments will be interchangeable. For instance, the diameter plug and/or sealing ridge of FIG. 10 and the packing of FIG. 9 may be used in conjunction with the embodiments of FIGS. 1–6. Indeed, the diameter plug may be used without the sealing ridge. Where the packing is used, a retaining ring may be present on the outer surface of the cylindrical circumferential wall of the measuring cup to aid in keeping the packing in place.

We claim:

1. A package comprising a) a container having a mouth cylinder including an outer spiral ridge and an outer locking circumferential ridge disposed above said outer spiral ridge, b) a plug body including a cylindrical wall, a guide-piece for regulating fluid poured out of said container extending vertically from the cylindrical wall within said cylindrical wall, c) said cylindrical wall including at its upper end an outwardly extending collar, d) said plug body including an outer cylinder depending from said cylindrical wall from the outwardly extending collar, e) said plug body outer cylinder including an inner locking ridge, f) said plug body including a sealing ridge protruding slantingly upwardly on an inner peripheral end of the upper surface of the outer collar, g) a cap comprising a top wall, an inner cylindrical circumferential wall, a radially extending cap collar, a cap cylinder depending from said cap collar, an inner spiral ridge disposed on an inner surface of the cap cylinder and a thickened cap wall seal part disposed beneath the cap collar in an outer surface of the cylindrical cap wall, said outer circumferential locking ridge interfitting said inner locking ridge, said plug body sealing ridge contacting elastically said thickened cap wall seal part and said outer spiral ridge engaging said inner spiral ridge when said plug is fitted within the container and said cap is screwed on.

2. The package of claim 1 further comprising an upper plug body collar sealing ridge extending from the upper surface of the plug body collar for contacting the cap collar and a lower plug body collar sealing ridge depending from a lower surface of the plug body collar for contacting an upper surface of the container mouth.

3. A package comprising a) a container having a mouth cylinder including an outer spiral ridge, b) a plug body including a cylindrical wall, a guide piece for regulating fluid poured out of said container extending vertically from a lower end of the cylindrical wall within said cylindrical wall, c) said cylindrical wall including at its upper end an outwardly extending collar, d) said plug body including an outer cylinder depending from said cylindrical wall from the outwardly extending collar, e) a cap comprising a top wall, an inner cylindrical circumferential wall, a outwardly extending cap collar, a cap cylinder depending from said cap collar, an inner spiral ridge disposed on an inner surface of the cap cylinder and a cap wall seal part disposed beneath the cap collar on an outer surface of the cylindrical inner cylindrical circumferential cap wall, the outer diameter of the cap wall seal part being set to a value whereby it can be fitted close against the cylindrical wall of the plug body, an inside diameter of a lower portion of the plug body cylindrical wall being set to a value whereby the lower portion of the inner circumferential wall of the cap can be fit close thereon, and said plug body cylindrical wall being spaced from said cap inner cylindrical wall intermediate said cap wall seal part and the lower portion of the inner circumferential cap wall, said outer spiral ridge engaging said inner spiral ridge when said plug is fitted within the container and said cap is screwed on.

4. The package of claim 3 further comprising an upper plug body collar sealing ridge extending from the upper surface of the plug body collar for contacting the cap collar and a lower plug body collar sealing ridge depending from a lower surface of the plug body collar for contacting an upper surface of the container mouth.

5. The package of claim 3 wherein the inner surface of said plug body outer cylinder includes an inner locking ridge and the outer surface of the container mouth cylinder includes an outer locking ridge interfitting said inner locking ridge when said plug body is fitted onto said cylinder.

6. A package comprising a) a container having a mouth cylinder including an outer spiral ridge, and an inwardly extending locking ridge, b) a plug body including a cylindrical wall, a guidepiece for regulating fluid poured out of said container extending vertically from a lower end of a plug body cylindrical wall within said cylindrical wall, c) said cylindrical plug wall including at its upper end an upper ridge extending outwardly below the upper edge of the mouth cylinder and not past said mouth cylinder, d) said plug body including a lower ridge extending outwardly from said plug body and spaced from said upper ridge such that when said plug is fitted within said mouth cylinder said inwardly extending locking ridge abuts said plug body cylindrical wall between said upper and lower outwardly extending ridges, e) a cap comprising a top wall, an inner cylindrical circumferential wall, an outwardly extending cap collar, a cap cylinder depending from said cap collar, an inner spiral ridge disposed on an inner surface of the cap cylinder and a packing disposed between said inner cylindrical circumferential wall and said cap cylinder and adjacent said cap collar, said packing contacting the upper surface of the mouth cylinder thereby sealing said mouth cylinder when said cap is screwed onto said container and the outer spiral ridge engaging said inner spiral ridge when said plug is fitted within the container and said cap is screwed on.

7. A package comprising a) a container having a mouth cylinder including an outer spiral ridge, and an inwardly extending locking ridge, b) a plug body including a cylindrical wall, a guidepiece for regulating fluid poured out of said container extending vertically from a lower end of the plug body cylindrical wall within said cylindrical wall, c) said cylindrical plug wall including at its upper end an upper ridge extending outwardly below the upper edge of the mouth cylinder and not past sad mouth cylinder, d) said plug body including a lower ridge extending outwardly and spaced from said upper ridge such that when said plug is fitted within said mouth cylinder said inwardly extending locking ridge abuts said plug body cylindrical wall between said upper and lower outwardly extending ridges, e) a cap comprising a top wall, an inner cylindrical circumferential wall, and outwardly extending cap collar, a cap cylinder depending from said cap collar, an inner spiral ridge disposed on an inner surface of the cap cylinder, said outer spiral ridge engaging said inner spiral ridge when said plug is fitted within the container and said cap is screwed on.

8. A package comprising a) a container having a mouth cylinder including an outer spiral ridge, and an inwardly extending locking ridge, b) a plug body including a cylindrical wall, a guidepiece for regulating fluid poured out of said container extending vertically from a lower end of a plug body cylindrical wall within said cylindrical wall, c) said cylindrical plug wall including at its upper end an upper ridge extending outwardly below the upper edge of the mouth cylinder and not past said mouth cylinder, d) said inwardly extending locking ridge abutting said plug body cylindrical wall below said outwardly extending ridge, e) a cap comprising a top wall, an inner cylindrical circumferential wall, an outwardly extending cap collar, a cap cylinder depending from said cap collar, an inner spiral ridge disposed on an inner surface of the cap cylinder and a packing disposed between said inner cylindrical circumferential wall and said cap cylinder and adjacent said cap collar, said packing contacting the upper surface of the mouth cylinder when said cap is screwed onto said container thereby sealing said mouth cylinder and the outer spiral ridge engaging said inner spiral ridge when said plug is fitted within the container and said cap is screwed on.

9. A package comprising a) a container having a mouth cylinder including an outer spiral ridge, and an inwardly extending locking ridge, b) a plug body including a cylindrical wall, a guidepiece for regulating fluid poured out of said container extending vertically from a lower end of a plug body cylindrical wall within said cylindrical wall, c) said cylindrical plug wall including at is upper end an upper ridge extending outwardly below the upper edge of the mouth cylinder and not past said mouth cylinder, d) said inwardly extending locking ridge abutting said plug body cylindrical wall below said outwardly extending ridge, e) a cap comprising a top wall, an inner cylindrical circumferential wall, an outwardly extending cap collar, a cap cylinder depending from said cap collar, an inner spiral ridge disposed on an inner surface of the cap cylinder, said outer spiral ridge engaging said inner spiral ridge when said plug is fitted within the container and said cap is screwed on.

10. The package of claim 7 wherein said cap further comprises a sealing ridge depending from said collar and abutting the top of said mouth cylinder when the cap is screwed onto the container and a diameter plug depending from the collar and abutting the inner surface of the mouth cylinder when the cap is screwed onto the container.

11. The package of claim 8 wherein said cap further comprises a sealing ridge depending from said collar and abutting the top of said mouth cylinder when the cap is screwed onto the container and a diameter plug depending from the collar and abutting the inner surface of the mouth cylinder when the cap is screwed onto the container.

* * * * *

UNITED STATES PATENT AND TRADEMARK OFFICE

CERTIFICATE OF CORRECTION

PATENT NO. : 5,108,009

DATED : April 28, 1992

INVENTOR(S) : Davidson et al

It is certified that error appears in the above-indentified patent and that said Letters Patent is hereby corrected as shown below:

Column 13, line 68:

Claim 6, line 7, replace "a" (second occurrence) with -- the --;

Column 14, line 39:

Claim 7, line 12, replace "sad" with -- said --;

Column 14, line 48:

Claim 7, line 21, replace "and" with -- an--;

Column 14, line 62:

Claim 8, line 7, replace "a" (second occurrence) with -- the --;

Column 15, line 24:

UNITED STATES PATENT AND TRADEMARK OFFICE

CERTIFICATE OF CORRECTION

PATENT NO. : 5,108,009

DATED : April 28, 1992

INVENTOR(S) : Davidson et al

It is certified that error appears in the above-indentified patent and that said Letters Patent is hereby corrected as shown below:

Claim 9, line 7, replace "a" (second occurrence) with -- the --;

Column 15, line 26:

Claim 9, line 10, replace "is" with -- its--;

Column 16, line 21:

Claim 11, line 1, replace "8" with -- 9 --.

Signed and Sealed this

Twenty-eighth Day of December, 1993

Bruce Lehman

*Attest:*

BRUCE LEHMAN

*Attesting Officer*

*Commissioner of Patents and Trademarks*